US009726129B2

(12) United States Patent
Pfeiffer

(10) Patent No.: US 9,726,129 B2
(45) Date of Patent: Aug. 8, 2017

(54) METHOD FOR DETERMINING A FUEL FRACTION IN OIL

(71) Applicant: Dr. Ing. h.c. F. Porsche Aktiengesellschaft, Stuttgart (DE)

(72) Inventor: Juergen Pfeiffer, Pforzheim (DE)

(73) Assignee: Dr. Ing. h.c. F. Porsche Aktiengesellschaft, Stuttgart (DE)

( * ) Notice: Subject to any disclaimer, the term of this patent is extended or adjusted under 35 U.S.C. 154(b) by 610 days.

(21) Appl. No.: 14/132,756

(22) Filed: Dec. 18, 2013

(65) Prior Publication Data

US 2014/0174408 A1 Jun. 26, 2014

(30) Foreign Application Priority Data

Dec. 20, 2012 (DE) ..... 10 2012 112 794

(51) Int. Cl.

| | |
|---|---|
| ***F02M 59/20*** | (2006.01) |
| ***F01M 1/18*** | (2006.01) |
| *F01M 1/16* | (2006.01) |
| *F01M 11/10* | (2006.01) |

(52) U.S. Cl.

CPC ..... *F02M 59/20* (2013.01); *F01M 1/18* (2013.01); *F01M 2001/165* (2013.01); *F01M 2011/148* (2013.01)

(58) Field of Classification Search

CPC .. F01M 1/02; F01M 1/16; F01M 3/00; F01M 3/02; F01M 11/10; F01N 33/28; F02M 59/20

USPC ... 123/1 A, 27 GE, 495–499, 510, 525, 575; 701/103–105

See application file for complete search history.

(56) References Cited

U.S. PATENT DOCUMENTS

| | | | | |
|---|---|---|---|---|
| 5,979,420 | A * | 11/1999 | Kawamura | F02M 31/0825 123/557 |
| 6,776,024 | B2 | 8/2004 | Jakoby | |
| 8,109,138 | B2 | 2/2012 | Han | |
| 8,342,013 | B2 | 1/2013 | Nedachi | |
| 8,371,823 | B2 | 2/2013 | Lee | |

(Continued)

FOREIGN PATENT DOCUMENTS

| | | |
|---|---|---|
| CN | 101769844 | 7/2010 |
| CN | 102086857 | 6/2011 |

(Continued)

OTHER PUBLICATIONS

Search Report DE 10 2012 112 794.8 dated Aug. 12, 2013 with partial English translation.

(Continued)

*Primary Examiner* — John Kwon
*Assistant Examiner* — Johnny H Hoang
(74) *Attorney, Agent, or Firm* — RatnerPrestia

(57) ABSTRACT

A method for determining a fuel fraction in the oil of an oil circuit (6), in particular in oil of an oil circuit (6) of an internal combustion engine (7), wherein a variably adjustable oil delivery pump (1) is provided in the oil circuit, which oil delivery pump can be actuated by means of a control unit (4), wherein the control unit performs an adjustment of parameters and/or adaptation values of the oil delivery pump as a function of the viscosity of the oil, wherein a determination of the fuel fraction in the oil is performed on the basis of the parameters and/or adaptation values.

8 Claims, 4 Drawing Sheets

(56) References Cited

U.S. PATENT DOCUMENTS

| | | | | |
|---|---|---|---|---|
| 8,707,773 | B2 * | 4/2014 | Blossfeld | F01M 1/18 73/114.55 |
| 2009/0114190 | A1 * | 5/2009 | Shafer | F02M 59/442 123/446 |
| 2011/0168137 | A1 * | 7/2011 | Yagi | F02D 19/0628 123/510 |
| 2012/0042657 | A1 * | 2/2012 | Hodinot | F02C 7/232 60/772 |
| 2014/0100765 | A1 * | 4/2014 | Maki | F01P 3/08 701/113 |

FOREIGN PATENT DOCUMENTS

| | | | |
|---|---|---|---|
| DE | 103 06 857 | A1 | 9/2004 |
| DE | 103 44 665 | A1 | 5/2005 |
| DE | 10 2004 032 44 | A1 | 1/2006 |
| DE | 10 2008 018 322 | A1 | 10/2009 |
| EP | 1 266 217 | | 12/2002 |
| EP | 2096434 | | 9/2009 |
| JP | 05240015 | | 9/1993 |
| JP | 06137126 | | 5/1994 |
| JP | 10317936 | | 12/1998 |
| JP | 200697496 | | 4/2006 |
| JP | 2009203916 | | 9/2009 |
| JP | 2010138817 | | 6/2010 |
| JP | 2010255469 | | 11/2010 |
| WO | WO 01/67096 | A1 | 9/2001 |

OTHER PUBLICATIONS

English Translation of the Chinese Search Report issued in corresponding Chinese Appl. No. 201310706247.0 issued Sep. 14, 2015.
English Translation of Chinese Office Action for Chinese Application No. 201310706247.0 issued Sep. 25, 2015.

* cited by examiner

METHOD FOR DETERMINING A FUEL FRACTION IN OIL

CROSS-REFERENCE TO RELATED APPLICATIONS

This application claims priority of German Patent Application No. 10 2012 112 794.8, filed Dec. 20, 2012, which is incorporated by reference herein in its entirety.

FIELD OF INVENTION

The invention relates to a method for determining a fuel fraction in oil, in particular for oil of an oil circuit for the lubrication of an internal combustion engine of a motor vehicle.

In motor vehicles with an internal combustion engine, an oil circuit is provided for the supply of lubricating oil for the internal combustion engine. Here, the viscosity of the oil is of importance for the lubrication action of the oil. If the viscosity of the oil decreases to too great an extent, the lubrication of the internal combustion engine can no longer be reliably ensured.

In vehicles with an internal combustion engine, an effect may be encountered whereby fuel mixes with oil and thus reduces the viscosity of the oil. This may in particular arise for different reasons such as frequent cold starts with short-distance operation, inadequate mixture preparation, inadequate warm-up phases in conjunction with start-stop operation or electric driving in the case of hybrid vehicles, or poor fuel quality with a late final boiling point.

BACKGROUND

DE 103 06 857 A1 discloses a method for determining a fuel content in the oil for the lubrication of a fuel pump, wherein the temperature of the lubricant or a component temperature of the fuel pump or of the internal combustion engine is determined. This however already assumes elevated friction in order that the friction can lead to an excessive increase in temperature, which is to be ascribed as a reaction to the reduced viscosity of the oil. A disadvantageous consequence of the viscosity reduction is thus provoked and awaited, and then detected. This is however considered to be disadvantageous for the oil circuit.

SUMMARY

It is therefore the object of the present invention to provide a method for determining the fuel fraction in oil, which method permits a reliable determination of the fuel fraction and at the same time makes do with little additional expenditure, in particular for additional sensors.

The object is achieved, with regard to a method for determining a fuel fraction in the oil of an oil circuit, in particular in oil of an oil circuit of an internal combustion engine, wherein a variably adjustable oil delivery pump is provided in the oil circuit, which oil delivery pump can be actuated by means of a control unit, wherein the control unit performs an adjustment of parameters and/or adaptation values of the oil delivery pump as a function of the viscosity of the oil, wherein a determination of the fuel fraction in the oil is performed on the basis of the parameters and/or adaptation values.

An exemplary embodiment of the invention concerns a method for determining a fuel fraction in the oil of an oil circuit, in particular in oil of an oil circuit of an internal combustion engine, wherein a variably adjustable oil delivery pump is provided in the oil circuit, which oil delivery pump can be actuated by means of a control unit, wherein the control unit performs an adjustment of parameters and/or adaptation values of the oil delivery pump as a function of the viscosity of the oil, wherein a determination of the fuel fraction in the oil is performed on the basis of the parameters and/or adaptation values. In this way, directly after the entrainment of fuel, the consequence can be performed on the basis of a reaction of the control unit to the detected properties of the oil.

It is also expedient if the determination of the fuel fraction in the oil is determined by means of the viscosity of the oil determined on the basis of the parameters and/or adaptation values. In this way, a reaction will take place immediately after the decrease in viscosity, before damage has occurred.

Here, it is expedient if the parameters and/or adaptation values are data for the control of the oil pressure at the pump outlet side and/or of the oil volume flow.

It is particularly advantageous if, during the adjustment of parameters and/or adaptation values of the oil pump, in order to take into consideration the viscosity of the oil, a pre-adjustment and/or a pre-adaptation is performed on the basis of the tolerances of the oil delivery pump, of the oil and/or of the aging of the oil.

It is also advantageous if the pre-adjustment takes place during an oil replenishment process and/or during ongoing operation. In this way, during oil replenishment with a new quantity of oil, the system can be reset, and adaptations can be performed with regard to present tolerances. It is also possible for a degree of aging of the oil owing to deposits, abrasion and the entrainment of soot to be stored in the control unit, which degree of aging can be readjusted for example on the basis of data determined previously by experiment or simulation.

It is also expedient if the actuation of the internal combustion engine takes place as a function of the determined fuel fraction in the oil. In this way, an operating situation can be realized which prevents a further entrainment of fuel and advantageously reduces the entrainment of fuel into the oil.

It is also expedient if the actuation takes place by virtue of at least one of the following steps being performed:

a. outputting information and/or instructions to the driver of the vehicle to warm up the internal combustion engine,
b. outputting information and/or instructions to the driver of the vehicle with regard to a workshop visit and/or an oil change,
c. varying the operating point of the internal combustion engine, for example by load-point shifting,
d. at least temporarily deactivating the start-stop function of the internal combustion engine,
e. at least temporarily prohibiting deactivation of the internal combustion engine in the case of a hybrid drive with electric motor and internal combustion engine, and/or
f. effecting the increase of the cooling water temperature and/or of the oil temperature.

BRIEF DESCRIPTION OF THE DRAWINGS

The invention will be explained in detail below on the basis of an exemplary embodiment and with reference to the drawing, in which.

DETAILED DESCRIPTION

Figure 1:
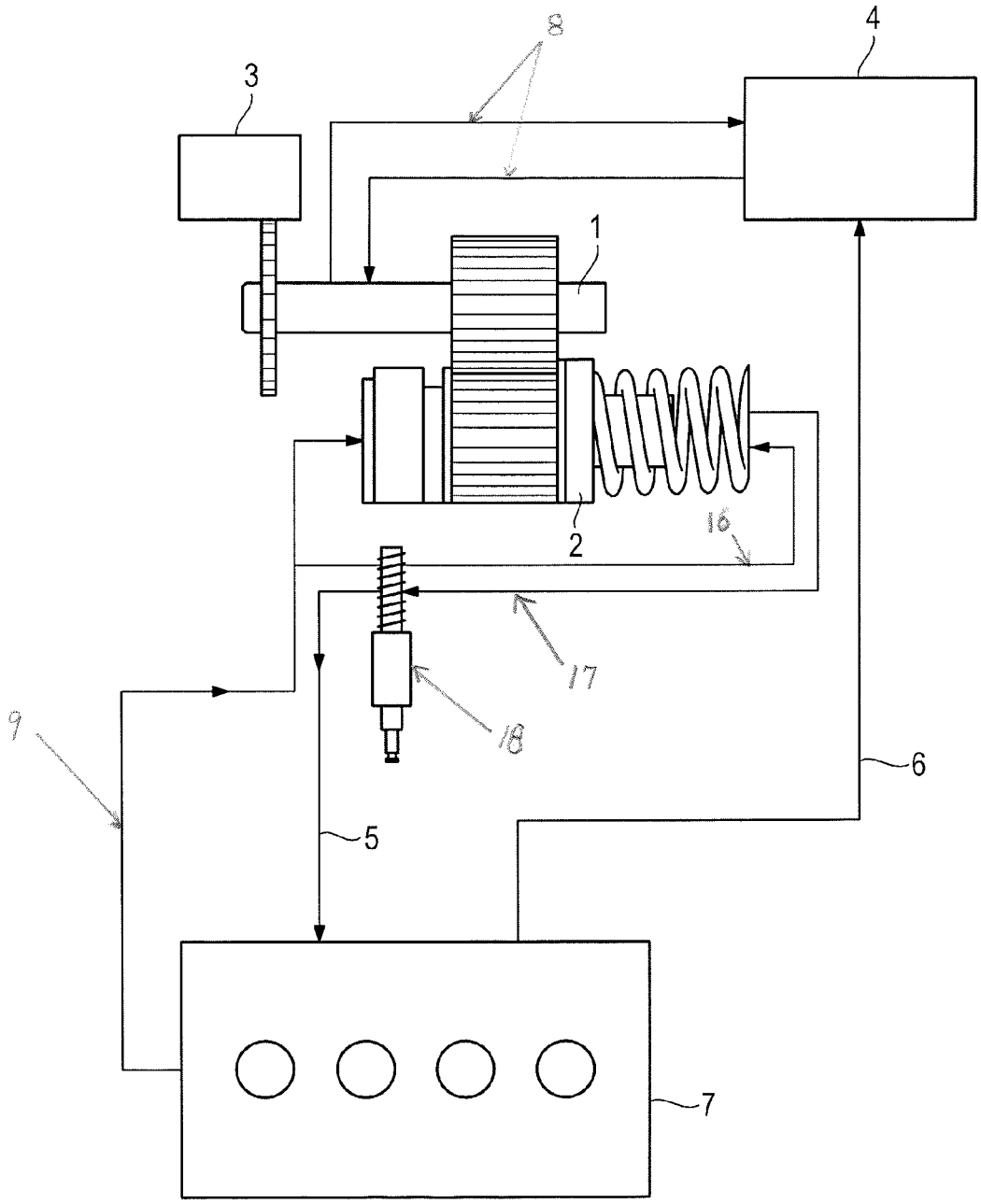
FIG. 1 is a schematic illustration of a device for carrying out the method according to the invention.

FIG. 1 shows an oil delivery pump 1 with fully variable oil pressure and oil volume flow control, wherein a piston 2 can be actuated in terms of its axial position, and the drive 3 of the oil delivery pump 1 can be actuated, by a control unit 4 via control lines 9 such that the oil pressure at the pump outlet side or the oil volume flow 5 at the pump outlet side can be controlled in a targeted manner.

The oil delivery pump 1 is arranged in an oil circuit 6 of an internal combustion engine 7 and is fed fresh oil from the oil pump and filter of the engine 7 via oil intake 9 and provides the required oil volume flows and the required oil pressure in particular for the lubrication of the internal combustion engine 7 the oil pressure at the pump outlet is controlled via proportional control valve 12 via oil control flow line 10 and oil return flow line 11.

For the situation in which fuel from the internal combustion engine 7 dissolves in the oil of the oil circuit 6, that is to say said fuel is absorbed in the oil, the invention provides a method for the determination of the fuel fraction in the oil of the oil circuit 6. Here, the control unit 4 controls an adjustment of parameters and/or adaptation values of the oil delivery pump 1 as a function of the viscosity of the oil, wherein a determination of the fuel fraction in the oil is performed on the basis of the parameters and/or adaptation values.

Figure 2:
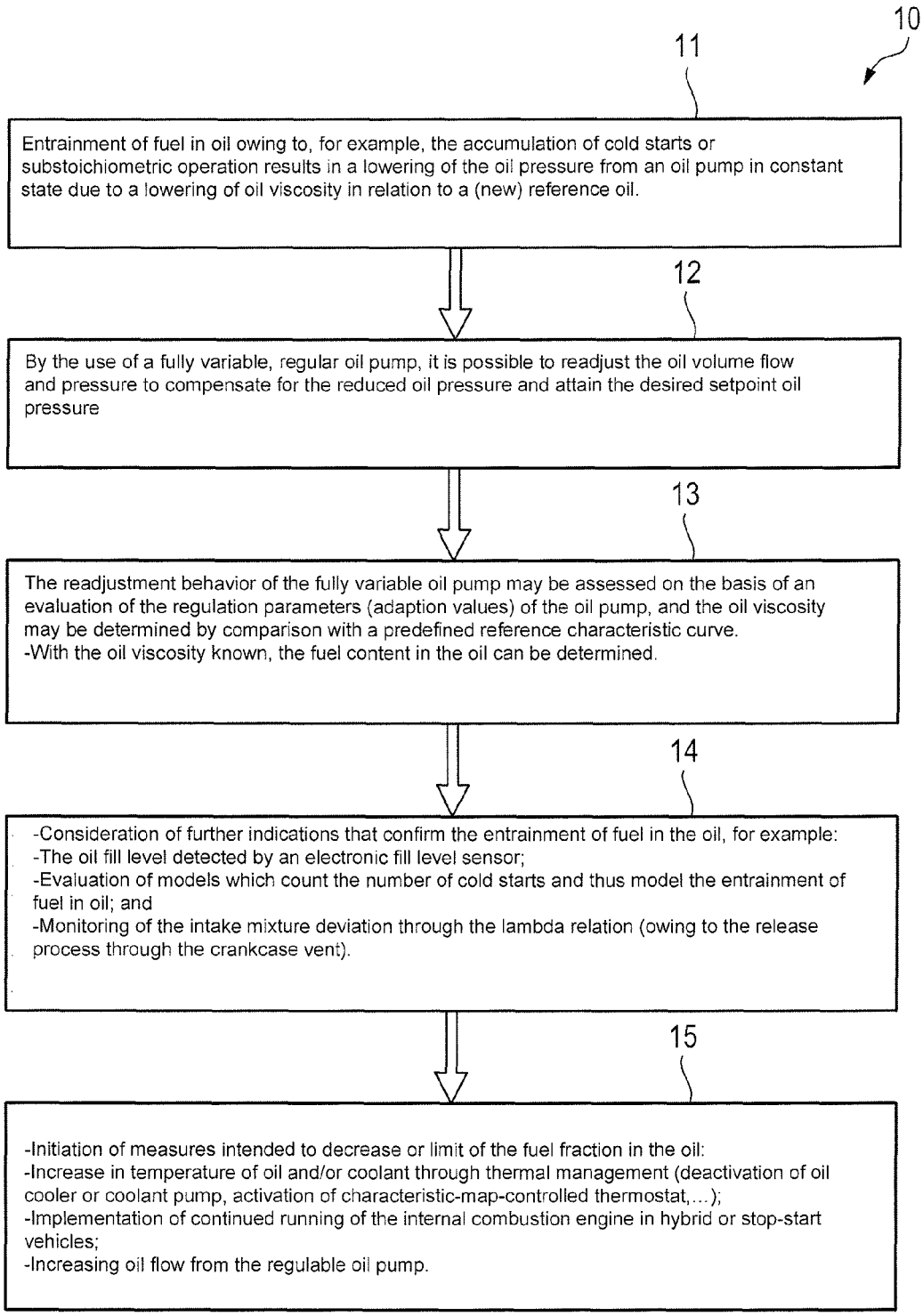
FIG. 2 is a block diagram.

FIG. 2 shows a block diagram 10 for explaining the method according to the invention.

Block 11 describes the entrainment of fuel into the oil. This may arise for example owing to the accumulation of cold starts or of substoichiometric operation of the internal combustion engine. Owing to the entrainment of fuel into the oil, the viscosity of the oil decreases; this results in a decrease in the oil pressure that would be encountered in the case of an oil delivery pump with constant delivery action, because the reduction of the viscosity of the oil in relation to a reference oil reduces the oil pressure in the case of a constant delivery rate.

Through the use of a fully variable, regulable oil delivery pump 1 as per block 12, it is possible, in order to compensate the reduced oil pressure, for the volume flow and the oil pressure to be readjusted in order to attain the desired setpoint oil pressure.

Block 13 explains that the readjustment behavior of the fully variable oil delivery pump 1 may be assessed on the basis of an evaluation of the regulation parameters or adaptation values of the oil delivery pump 1, and that the viscosity of the oil can be determined from this by way of a comparison with a predefined reference characteristic curve. With the knowledge of the viscosity as per block 13, the fuel content in the oil can be determined.

Furthermore, as per block 14, it is also possible for further indications that confirm the entrainment of fuel into the oil to be taken into consideration. Here, it is for example possible to determine the oil fill level detected by an electronic fill level sensor. It is also possible to take into consideration the evaluation of models which count the number of cold starts and thus model the entrainment of fuel into the oil. It is also possible to monitor the mixture deviation resulting from the lambda regulation owing to release processes through the crankcase vent.

Said further indications or items of information may additionally be taken into consideration, in addition to the regulating parameters and/or adaptation values, in order to determine the entrainment of fuel into the oil.

Subsequently, in block 15, after the detection of the fuel fraction in the oil, measures are initiated which are intended to effect a decrease of the fuel fraction in the oil or to at least prevent an increase of the fuel fraction in the oil. The measures may for example be initiated if the fuel content exceeds a predefinable value, for example if the fuel content exceeds a value of 5%.

Here, it is for example possible for an increase in temperature of the oil and/or of the coolant to be performed by means of the thermal management of the internal combustion engine, for example by means of a deactivation of an oil cooler or of a coolant pump. Also, a targeted actuation of a characteristic-map-controlled thermostat may have the effect of realizing an increase in temperature of the oil or of the coolant. This promotes an increased release of the fuel from the oil.

Furthermore, demands for continued engine running may be implemented such that start-stop operation is not activated for example when the vehicle is stopped at a traffic signal, or no purely electric-motor-powered driving states are activated in the case of a vehicle with hybrid drive, that is to say with an internal combustion engine and electric motor. In this way, the internal combustion engine continues to be operated or is operated for longer, such that the temperature of the oil rises, rather than the internal combustion engine being deactivated owing to start-stop operation or electric-motor-powered operation, such that the oil can cool again.

An increase of the volume flow of the regulable oil pump may also be implemented.

Furthermore, as remedial measures, information or instructions may be output to the driver on a display or by acoustic output means, such that the vehicle is warmed up further. Alternatively, or in addition, information or instructions may be output that prompt the driver to visit a workshop or perform an oil change.

A load-point shift of the internal combustion engine 7 may also be performed such that, owing to the changed operating point of the internal combustion engine 7, an increased amount of waste heat is generated such that the coolant and/or the oil are more intensely heated. In the case of coolant heating, it is to be assumed that, by means of the heat exchanger in the oil circuit, the additionally heated coolant also causes the temperature of the oil to be increased more intensely.

Figure 3:
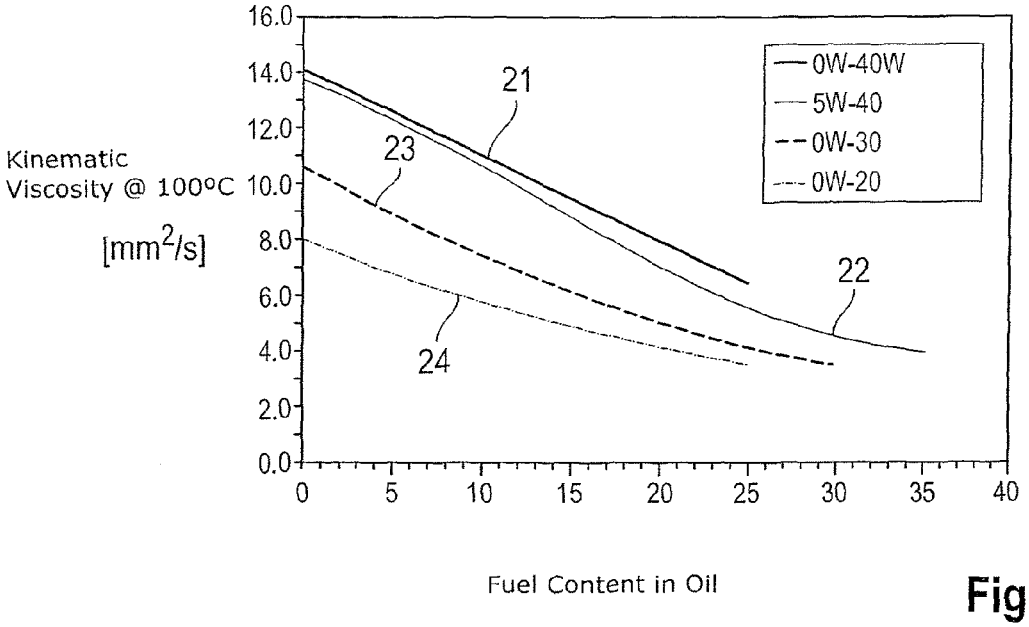
FIG. 3 is a diagram.

FIG. 3 shows the viscosity of the oil as a function of the fuel content in the oil, wherein different oil types are illustrated in FIG. 3. The uppermost curve illustrates the viscosity characteristic in the case of different fuel contents for a 10W-40 oil. The curve 22 illustrates a corresponding 5W-40 oil. The curve 23 illustrates a 0W-30 oil, and the curve 24 illustrates a 0W-20 oil. It can be seen that, from 0 to 25% volume fraction of fuel in the oil, the viscosity of the oil falls to approximately half the viscosity of the pure oil without entrained fuel.

If such an oil is used in the internal combustion engine 7, such that, in the case of a certain fuel content in the oil, the viscosity falls as per the curves in FIG. 3, such that the fully variable oil delivery pump 1, in accordance with the actuation, increase the oil pressure and/or the oil delivery volume by means of parameters or adaptation values in order to attain the lubrication required for the internal combustion engine 7.

Figure 4:
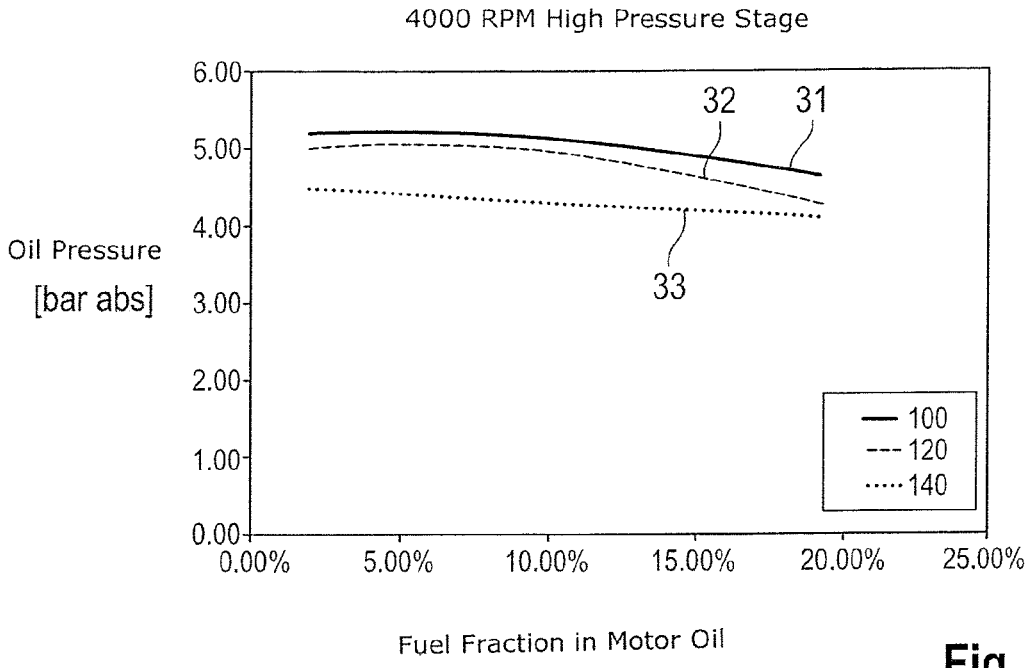
FIG. 4 is a diagram.
Figure 5:
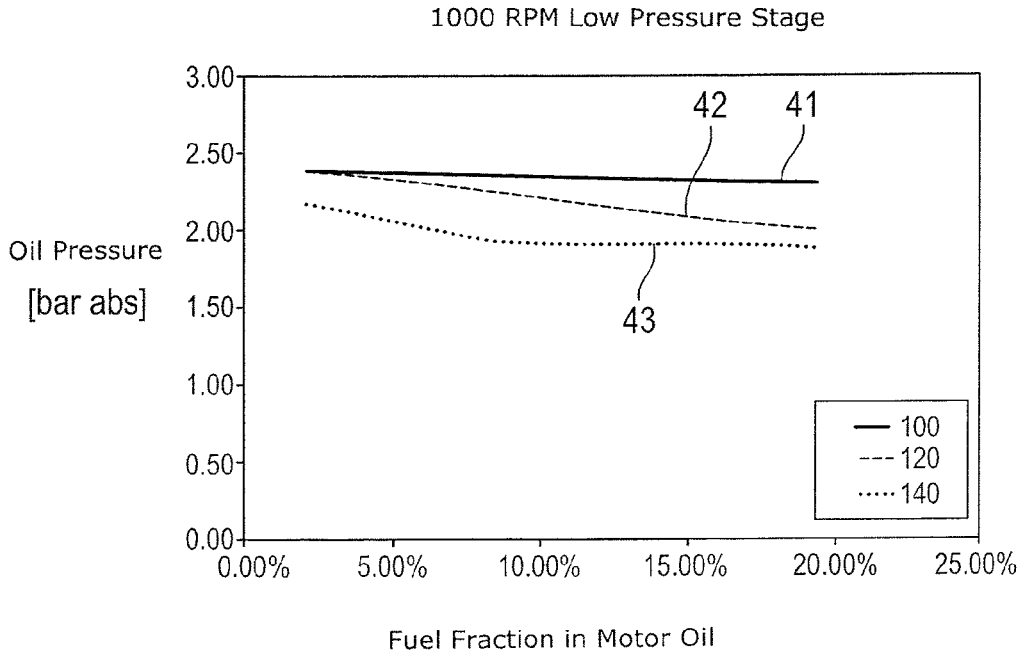
FIG. 5 is a diagram.

FIGS. 4 and 5 show the oil pressure of an internal combustion engine 7 as a function of the oil temperature of a two-stage pump, at 100° Celsius in the case of curves 31 and 41, wherein FIG. 4 illustrates the oil pressure in the high-pressure stage of the oil pump at 4000 revolutions per minute, and FIG. 5 shows the oil pressure in the low-pressure stage of the oil pump at 1000 revolutions per minute. Here, in each case, the oil pressure is illustrated as a function of the fuel fraction in the engine oil. In addition to the curves 31 and 41, further curves 32 and 42 and also 33 and 43 are also illustrated. The curves 31 and 41 represent the curves at 100° Celsius oil temperature, the curves 32 and 42 represent an oil temperature of 120° Celsius and the curves 33 and 43 represent the curves for an oil temperature of 140° Celsius. As per the curves 31 to 43, the oil pressure varies as a function of the fuel fraction and the temperature. In the case of relatively low oil temperatures of approximately 100° Celsius, the oil pressure decreases in the case of relatively high fuel fractions, whereas, at relatively high temperatures, even a relatively low fuel fraction in the oil is sufficient to cause the oil pressure to drop.

It can be concluded from this that, with increasing fuel fraction in the oil, there is reduced viscosity and a reduced oil pressure in the internal combustion engine, such that the fully variable oil delivery pump must be correspondingly actuated by means of changed parameters or adaptation values in order to maintain the required oil pressure in the internal combustion engine.

Here, for example in the case of a fully variable oil delivery pump 1 with axially displaceable piston as per FIG. 1, a displacement of the piston may be controlled so as to result in an increased oil pressure and/or increased oil delivery rate.

LIST OF REFERENCE NUMERALS

1 Oil delivery pump
2 Piston
3 Drive
4 Control unit
5 Oil volume flow
6 Oil circuit
7 Internal combustion engine
8 Control lines
9 Oil pump intake
10 Block diagram
11 Block
12 Block
13 Block
14 Block
15 Block
16 Oil control flow line
17 Oil return flow line
18 Proportional control valve
21 Curve
22 Curve
23 Curve
24 Curve
31 Curve
32 Curve
33 Curve
41 Curve
42 Curve
43 Curve

The invention claimed is:

1. A method for determining a fuel fraction in lubrication oil circulating in an oil circuit (6) of a water-cooled internal combustion engine (7) in a vehicle operated by a driver, said internal combustion engine having a start-stop function, a variable operating point, and cooling water, wherein a variably adjustable oil delivery pump (1) is provided in the oil circuit (6), said pump having an outlet side and delivering a volume flow (5) of oil, which oil delivery pump is actuated by a control unit (4), wherein the control unit (4) performs an adjustment of parameters and/or adaptation values of the oil delivery pump (1) as a function of oil viscosity, wherein a determination of the fuel fraction in the oil is performed on the basis of the parameters and/or adaptation values.

2. The method as claimed in claim 1, wherein the determination of the fuel fraction in the oil on the basis of the parameters and/or adaptation values is by comparison of the oil viscosity with a characteristic reference curve.

3. The method as claimed in claim 1, wherein the parameters and/or adaptation values are data for the control of oil pressure at the pump outlet side and/or of the oil volume flow (5) of the oil delivery pump (1).

4. The method as claimed in claim 1, wherein, during the adjustment of parameters and/or adaptation values of the oil delivery pump (1), in order to take into consideration the viscosity of the oil, a pre-adjustment and/or a pre-adaptation is performed on the basis of tolerances of the oil delivery pump (1), of the oil and/or of aging of the oil.

5. The method as claimed in claim 4, wherein the pre-adjustment takes place during an oil replenishment process and/or during ongoing operation.

6. The method as claimed in claim 1, wherein the internal combustion engine (7) is actuated as a function of the determined fuel fraction in the oil.

7. The method as claimed in claim 6, wherein the actuation takes place by virtue of at least one of the following steps being performed:

a. outputting information and/or instructions to the driver of the vehicle to warm up the internal combustion engine (7),
b. outputting information and/or instructions to the driver of the vehicle with regard to a workshop visit and/or an oil change,
c. varying the operating point of the internal combustion engine (7),
d. at least temporarily deactivating the start-stop function of the internal combustion engine (7),
e. at least temporarily prohibiting deactivation of the internal combustion engine (7) in the case of a hybrid drive with electric motor and internal combustion engine, and/or
f. effecting an increase of cooling water temperature and/or of oil temperature.

8. The method as claimed in claim 7, wherein the operating point of the internal combustion engine (7) is varied by load point shifting.

* * * * *